United States Patent [19]

Kanemoto et al.

[11] Patent Number: 4,474,361

[45] Date of Patent: Oct. 2, 1984

[54] OXYGEN-BLOWN STEELMAKING FURNACE

[75] Inventors: Michitaka Kanemoto; Toru Yoshida; Yuziro Ueda, all of Sakai; Katsuyuki Isogami, Takaishi, all of Japan

[73] Assignee: Nippon Steel Corporation, Tokyo, Japan

[21] Appl. No.: 501,964

[22] Filed: Jun. 9, 1983

Related U.S. Application Data

[63] Continuation of Ser. No. 287,810, Jul. 28, 1981.

[30] Foreign Application Priority Data

Jul. 30, 1980 [JP] Japan ..... 55-103668
Jul. 30, 1980 [JP] Japan ..... 55-103669

[51] Int. Cl.[3] ..... C21C 5/32
[52] U.S. Cl. ..... 266/96; 75/60
[58] Field of Search ..... 75/60, 59; 266/96

[56] References Cited

U.S. PATENT DOCUMENTS 3,377,158 4/1968 Meyer ..... 75/60
3,551,140 12/1970 Nilles ..... 75/60
3,574,598 4/1971 Kern ..... 75/60

*Primary Examiner*—Peter D. Rosenberg

*Attorney, Agent, or Firm*—Cushman, Darby & Cushman

[57] ABSTRACT

An oxygen blow steelmaking furnace comprises a device for supplying materials for blowing into the furnace, a plurality of sensing devices, and a computer control device. The supplying device supplies into the furnace oxygen and fluxes from above and, as occasion demands, at least one of oxygen, carbon dioxide and inert gas from below. The sensing devices individually respond to different properties that represent the blowing condition. The computer control device sets a program for the blow based on the charging and blowing-out conditions, responds to the sensing devices, and outputs the operating instructions to the supplying device. The computer control device includes a device that determines the oxygen content is slag based on the aforementioned properties and the amount of operational correction according to the deviation between the computed and targeted oxygen contents, and a device that estimates, immediately before the completion of the blow, the temperature and carbon content of the hot metal at the end point based on the aforesaid properties and oxygen content in slag and determines the amount of operational correction according to the difference between the estimated and targeted hot-metal temperatures and carbon contents.

5 Claims, 21 Drawing Figures

OXYGEN-BLOWN STEELMAKING FURNACE

This is a continuation of application Ser. No. 287,810, filed July 28, 1981.

BACKGROUND OF THE INVENTION

This invention relates to an oxygen-blown steelmaking furnace into which pure oxygen is top-blown, and either nothing or one or two of oxygen, carbon dioxide and inert gas are bottom-blown.

Recently, a second look has been given to bottom-blown steelmaking furnaces, in an attempt to make up for the shortcomings of top-blown furnaces such as great oxidization-induced iron loss and poor dephosphorization. But the bottom-blown furnaces are not without problems. For example, the minimum hot-metal ratio in the charge is higher because less iron is oxidized during blowing. Also, top-blown furnaces cannot be remodelled into the bottom-blown type easily because of complex equipment requirements.

Thus, bottom- as well as top-blown furnaces, into which pure oxygen is top-blown and oxygen, carbon dioxide and/or inert gas is bottom-blown, have been proposed.

But even this last-mentioned type involves several operating problems calling for improvement.

The bottom- and top-blown furnaces now in common use are equipped with such a hot-metal temperature and carbon content control device as measures the actual temperature and carbon content of hot metal immediately, for example between 1 and 5 minutes, before the completion of blowing by use of a sublance. Then, the targeted hot metal temperature Tt and carbon content Ct are obtained by changing the level of the lance, the quantity of fluxes added, and the quantity of oxygen, carbon dioxide and inert gas blown according to the difference between the measured and targeted values.

Through the experience in operation, however, the inventors learnt that the aforementioned conventional device required improvement since it was unable to attain the targeted hot metal temperature and carbon content with high enough precision. It was also found that the conventional control device was unable to effectively control the phosphorus and manganese contents, although their variations are less than in the top-blown furnaces.

Although known as the dynamic control, this conventional technique performs static computation based on the hot-metal information collected through the measurement made by use of a sublance. It does not go as far as to determine the changes in the decarburizing and slag-making reactions during blowing. Accordingly, despite various operating efforts, the accuracy with which the targeted hot-metal temperature and carbon content are attained is not high enough. Also, the varying slag-making reactions entail considerable variations in the phosphorus and manganese contents in hot metal. These shortcomings call for improvement.

The following gives a more detailed description of the static and dynamic control mentioned before.

As stated previously, there are known steelmaking furnaces which are equipped with a device to perform static control or one to perform dynamic control, or one to perform both. Static control is a process that presets various operating conditions, such as the quantity of oxygen to be blown and that of fluxes to be added, before starting refining and completes refining according to the preset program. Meanwhile, dynamic control completes refining while modifying the operating conditions based on the dynamic information collected during the course of refining.

Various methods have been proposed for collecting the aforementioned dynamic information; such as one that analyzes the waste gas from the refining process as disclosed in the "Method of Controlling Oxygen Furnace (Japanese Patent Publication No. 23695 of 1967)" and "Method of Monitoring and Controlling in the Oxygen Top Blowing Process (Japanese Patent Publication No. 4088 of 1968)," one that uses a sublance as disclosed in the "Method of Controlling the Basic Oxygen Steelmaking Process (U.S. Pat. No. 3,574,598)," and one that combines the analysis of waste gas with the use of sublance as disclosed in the "Method of Estimating Hot-metal Temperature and Carbon Content in Oxygen Furnace (Japanese Patent Public Disclosure No. 101617 of 1977)" proposed by the inventors. Especially the last-mentioned combination method has greatly improved the precision with which the targeted temperature and carbon content of hot metal are attained at the end-point. Some other proposed methods lay emphasis on the operation of the top- and bottom-blown furnaces, such as those disclosed in the "Process and Apparatus for Making Alloy Steels (Japanese Patent Public Disclosure No. 8109 of 1976)" and "Method of Operating Oxygen Furnaces (Japanese Patent Public Disclosure No. 146711 of 1977)." But these methods involve the following problems.

Namely, even when it is expected to raise the hot-metal temperature by varying the lance level, the quantity of oxygen supply, and the decarburizing and slag-making reactions by varying the ratio of oxygen consumption therebetween through the control of carbon dioxide and inert gas supplies, the aforementioned methods do not offer any measured data by which the results of such changes can be estimated. Consequently, the change in the hot-metal temperature and carbon content near the end point can be corrected only by cooling.

In this type of practice, the quantity of flux addition is preset so that the hot-metal temperature at the end point would become slightly higher than the targeted level. Then the targeted temperature is attained by correcting the addition based on the latest information collected as the operation nears toward the end point. Accordingly, the temperature of hot metal remains higher than is desired over the greater part of the blowing period, producing a detrimental effect on the furnace refractories. Dephosphorization is one of the objects of the blowing given into the oxygen furnace. But the higher hot-metal temperature creates a metallurgical atmosphere undesirable for dephosphorization. This necessitates either adding more base or oxidizing the slag to a greater extent, but both steps are not free from quality and cost problems. In the "Method of Estimating Hot-metal Temperature and Carbon Content in Oxygen Furnace (Japanese Patent Public Disclosure No. 101617 of 1977)," mentioned previously, and the "Method of Controlling Hot-metal Temperature and Carbon Content in Oxygen Furance (Japanese Patent Public Disclosure No. 101618)," the accuracy of control is improved by continuously measuring the in-furnace distribution of oxygen, near the end point, consumed for decarburization and iron-oxidization. According to these methods, the hot-metal temperature can be lowered by adding more fluxes. The temperature can be raised by varying the lance level, the quantity of oxygen supply, and the decarburizing and slag-making reactions by varying the ratio of oxygen consumption therebetween through the control of carbon dioxide and inert gas supplies, with such changes properly measured. So it is unnecessary to make such flux addition as might raise the hot-metal temperature slightly above the targeted level, confining the method of correction to cooling. Even then, however, the changes in the hot-metal temperature and carbon content up to near the end point may possibly deviate greatly from the course in which their end-point targets can successfully be hit. Under such circumstances, the supply of oxygen, carbon dioxide and inert gas, the quantity of flux addition, and the level of the lance must be varied compensatingly. But such actions introduce a significant change in the oxygen distribution in the furnace, make the slag-making reaction unstable, and cause wide variations in the phosphorus, manganese and oxygen contents in steel, giving rise to serious cost and quality problems.

To solve these problems, as mentioned previously, it is necessary to develop a high-precision static control measure and a dynamic control measure well-matched thereto. Various static control measures have been proposed, but, to the knowledge of the inventors, none of them can ensure high-precision control.

SUMMARY OF THE INVENTION

An object of this invention is to provide an oxygen-blown steelmaking furnace that enables such blowing that the targeted hot-metal temperature and carbon content are attained at the end point with high precision.

Another object of this invention is to provide an oxygen-blown steelmaking furnace that enables such blowing that the targeted phosphorus and manganese contents in hot metal, or those close to the targeted ones, are attained at the end point.

Still another object of this invention is to provide an oxygen-blown steelmaking furance that enables such blowing that the targeted hot-metal temperature and chemical composition are attained at the end point with high precision by preliminarily selecting a reference pattern for the quantity of oxygen to be accumulated in slag during blowing, computing the ever-changing oxygen content in slag as blowing proceeds, and correcting the difference between the calculated value and reference pattern.

Yet another object of this invention is to provide an oxygen-blown steelmaking furnace that enables automatic blowing requiring little or no manual operation.

A further object of this invention is to provide an oxygen-blown steelmaking furnace that gives better agitation to hot metal, entails less fume loss, and ensures higher iron-to-steel yield.

The oxygen-blown steelmaking furnace according to this invention comprises a device to feed hot metal to be blown, a plurality of sensors, and a computer control unit. The feed device supplies oxygen and fluxes from above the furnace and, as the case may be, at least one of oxygen, carbon dioxide, and inert gas from below. The sensors individually detect changes in different properties that represent the blowing condition. The computer control unit establishes a program for the blowing process based on the charging and blowing-out conditions, and outputs operating instructions to the feed device according to the information supplied from the sensors. The computer control unit includes a device that calculates the actual oxygen content in slag based on the aforesaid properties and, then, the amount of correction needed in operation according to the difference between the calculated and targeted oxygen contents, and a device that estimates, as the blow approaches the end point, the hot-metal temperature and carbon content based on the aforesaid properties and oxygen content in slag and, then, the amount of correction needed in operation according to the difference between the estimated and targeted temperatures and carbon contents.

Equipped with a device to perform comprehensive control by combining a static control that prepares an operating program based on the charging and blowing-out conditions and a dynamic control that utilizes process signals obtained during blowing, the oxygen-blown steelmaking furnace of this invention characteristically employs the oxygen content in slag as a key index for control. Thanks to this use of slag-based information in blow control, the furnace according to this invention achieves both material and heat balances with greater accuracy than ever. It also controls the blowing reaction itself by continuously monitoring and controlling a change in the oxygen content in slag that governs the reaction in the furnace. Further, it corrects its operation according to the end-point hot-metal temperature and carbon content estimated based on the oxygen content in slag. All this results in the high-precision hitting of the targeted hot-metal temperature as well as carbon, phosphorus and manganese contents at the end point.

DETAILED DESCRIPTION OF THE PREFERRED EMBODIMENTS

Figure 1:
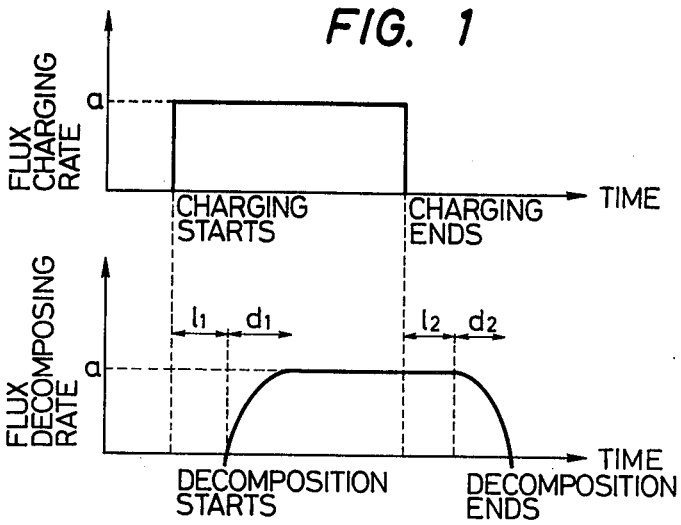
FIG. 1 is a graphical representation of the dead and lag time in the flux decomposing reaction.

One of the main characteristics of this invention, as stated before, lies in the use of the oxygen content in slags as a key parameter for computation in the aforementioned static control, which can be derived from the quantity of oxygen blown, the quantity of bottom-blown carbon dioxide and inert gas, the kind and charging speed of fluxes, and the quantity and chemical composition of the exhaust gas.

The handling of the in-slag oxygen content as an arithmetic parameter in static control is naturally determined by the equation employed for that purpose. There are various factors that affect the material and heat balances. But the common static control method corrects only such factors as the quantities of blown oxygen, carbon dioxide and/or inert gas, and charged iron ore that are enough for offsetting the deviation from the reference heat. To simplify the operation model, less-related and less-varying factors are eliminated. Even so, various mathematical expressions are available for the static control. Now, introduction of the in-slag oxygen content in static control model will be explained using a simple example. Of course, it can be applied to other static control models, too. When using other static control models, the in-slag oxygen content should likewise be inserted in suitable material and heat balance equations.

(Example)

A known static control model expressed by equations (1) through (4) is converted into one that is expressed by equations (5) through (8), as follows:

End-point temperature $$T_E = T_{E.R} + \Sigma\{F(X_i) - F(X_{i.R})\} \quad (1)$$

Iron ore charged $$\begin{aligned} W_O = {} & W_{O.R} + aW_{SB}(T_{E.R} - T_E - \alpha T) + b(W_{HP.R} - W_{HP}) \\ & + c(W_{CP.R} - W_{CP}) + d(W_{SP.R} - W_{SP}) + e(W_{SC.R} - W_{SC}) \\ & + f(W_{LS.R} - W_{LS}) + \{F_T(W_{BL.R}) - F_T(W_{BL})\} + \{F_T(W_{FL.R}) \\ & - F_T(W_{FL})\} + g(Si_{HP.R} - Si_{HP}) + h(T_{HP.R} - T_{HP}) \\ & + j\{F_T(C_{E.R}, P_{X.R}) - F_T(C_E, P_X)\} + \{F_T(Q_{CO_2.R}) - F_T(Q_{CO_2})\}) \\ & + kH_L + \beta_T + 1 \end{aligned} \quad (2)$$

Oxygen blown $$\begin{aligned} Q_X = {} & Q_{X.R} + F(\Delta W_{HP}) + F(\Delta W_{CP}) + [(F(W_O) - F(W_{O.R})\} \\ & + \{F(W_{SC}) - F(W_{SC.R})\} + \{F(W_{FL}) - F(W_{FL.R})\} \\ & + \{F(W_{LS} - F(W_{LS.R})\} + [F(W_{BL} - F(W_{BL.R})\} \\ & + \{F_C(C_E, P_X) - F_C(C_{E.R}, P_{X.R})\} + \{F(Q_{CO_2}) - F(Q_{CO_2.R}) \\ & + mH_L + \alpha_C + \beta_C + n \end{aligned} \quad (3)$$

Carbon dioxide blown $$\begin{aligned} Q_{CO_2} = {} & Q_{CO_2.R} + \{F_D(W_{HP.R}) - F_D(W_{HP})\} + \{F_D(W_{CP.R}) - F_D(W_{CP})\} \\ & + \{F_D(T_{HP.R}) - F_D(T_{HP})\} + r \end{aligned} \quad (4)$$

where

X = factor
W = weight
C = carbon content (%)
T = temperature
t = time
F, F() = functions
Q = quantity of oxygen
P = pressure
$H_L$ = lance height
$\alpha$ = temperature corrected according to furnace volume change
$\beta$ = weight corrected as a result of slopping a, b. c . . . w = constants (Suffixes)
P = pig iron
HP-hot pig
CP = cold pig
SP = iron scrap
SB = molten steel
O = iron ore
LS = limestone
BL = burnt lime
FL = fluorite
E = end point
R = reference performance (or reference value)
T = heat
X = oxygen blown
C = carbon
D = carbon dioxide
Si = silicon End-point temperature $$T_E = T_{E.R} + \Sigma\{F(X_i) - F(X_{i.R})\} \quad (5)$$

Iron ore charged $$\begin{aligned} W_O = {} & W_{O.R} + aW_{SB}(T_{E.R} - T_E - \alpha_H) + b(W_{HP.R} - W_{HP}) \\ & + c(W_{CP.R} - W_{CP}) + d(W_{SP.R} - W_{SP}) + e(W_{SC.R} - W_{SC}) \\ & + f(W_{LS.R} - W_{LS}) + \{F_T(W_{BL.R}) - F_T(W_{BL})\} + \{F_T(W_{FL.R}) \\ & - F_T(W_{FL})\} + g(Si_{HP.R} - Si_{HP}) + h(T_{HP.R} - T_{HP}) \\ & + j\{F_T(C_{E.R}, P_{X.R}) - F_T(C_E, P_X)\} + \{F_T(Q_{CO_2.R}) - F_T(Q_{CO_2})\} \\ & + q(Q_{OS.R} - Q_{OS}) + kH_L + \beta_T + 1 \end{aligned} \quad (6)$$

Oxygen blown $$\begin{aligned} Q_x = {} & Q_{X.R} + F(\Delta W_{HP}) + F(\Delta W_{CP}) + \{F(W_O) - F(W_{O.R})\} \\ & + \{F(W_{SC}) - F(W_{SC.R})\} + \{F(W_{FL}) - F(W_{FL.R})\} \\ & + \{F(W_{LS}) - F(W_{LS.R})\} + \{(F(W_{BL}) - F(W_{BL.R})\} \\ & + \{F_C(C_E, P_X) - F_C(C_{E.R}, P_{X.R})\} + \{F(Q_{CO_2}) - F(Q_{CO_2.R})\} \\ & + P(Q_{OS} - Q_{OS.R}) + \alpha_C + \beta_C + n \end{aligned} \quad (7)$$

carbon dioxide blown $$\begin{aligned} Q_{CO_2} = {} & Q_{CO_2.R} + \{F_D(W_{HP.R}) - F_D(W_{HP})\} + \{F_D(W_{CP.R}) \\ & - F_D(W_{CP})\} + \{F_D(T_{HP.R}) - F_D(T_{HP})\} + r \end{aligned} \quad (8)$$

where OS is the oxygen content in slag, which can be determined from equation (9) and (10) as follows:

$$dO_S = F_{OX} + F_{CO_2}{}^{iP} + \Sigma(\alpha_i + \beta_i + \tfrac{1}{2} \cdot \gamma_i) \cdot W_{Fi}{}^{*} - (\tfrac{1}{2}F_{CO}E + F_{CO_2}E) \quad (9)$$

-continued $$O_S = \int_{t_1}^{t_2} (dO_S) \cdot dt \quad (10)$$

where $F_{OX}$=quantity of pure oxygen blown $F_{CO}^E$=quantity of CO produced in the furnace $F_{CO_2}^E$=quantity of $CO_2$ produced in the furnace $W_{Fi}^*$=rate at which flux i is decomposed in the furance $\alpha_i$=coefficient with which flux i generates $O_2$ $\beta_i$=coefficient with which flux i generates $CO_2$ $\gamma_i$=coefficient with which flux i generates $H_2O$ $dO_S$=change in the oxygen content is slag $O_S$=oxygen content in slag t=time $F_{CO_2}^{iP}$=quantity of carbon dioxide, but when inert gas is used $F_{CO_2}^{iP}=O$ In estimating the quantity of the gases generated in the furance, the combustion due to the atmosphere sucked from between the furance mouth and hood should be corrected keeping an eye on the $N_2$ or Ar balance in the waste gas composition.

The following equations show examples of the $N_2$ balance $$F_{CO}^E = F_{CO} + 2\{(K_{O2}/K_{N2})(F_{N2} - F_{N2}^{iP}) - F_{O2}\} \quad (11)$$

$$F_{CO_2}^E = F_{CO_2} - 2\{(K_{O2}/K_{N2})(F_{N2})(F_{N2} - F_{N2}^{iP}) - F_{O2}\} \quad (12)$$

where $F_{CO}$=quantity of CO in the waste gas $F_{CO_2}$=quantity of $CO_2$ in the waste gas $F_{N2}$=quantity of $N_2$ in the waste gas $F_{O2}$=quantity of $O_2$ in the waste gas $K_{O2}$=$O_2$ content in the atmosphere $K_{N2}$=$N_2$ content in the atmosphere $F_{N2}^{iP}$=quantity of $N_2$ used as inert gas, but when carbon dioxide or other inert gas that $N_2$ (such as Ar) is used $F_{N2}^{iP}=0$ The quantity of each component in the exhaust gas can be determined by multiplying the quantity of the waste gas by the concentration of each component in it. When the flowmeter is of the differential type and the gas analyzer posseses a sampling system, analysis lag time occurs generally. Naturally, more accurate control results when this lag time is taken into consideration. If this lag time $\tau$ is considered, the quantity of each gas is expressed as follows, in which $(t-\tau)$ means the time $\tau$ hours ago:

$$F_{CO}(t-\tau) = X_{CO(t)} \cdot F_{ex(t-\tau)} \quad (13)$$

$$F_{CO_2}(t-\tau) = X_{CO_2(t)} \cdot F_{ex(t-\tau)} \quad (14)$$

$$F_{N2}(t-\tau) = X_{N2(t)} \cdot F_{ex(t-\tau)} \quad (15)$$

$$F_{O2}(t-\tau) = X_{O2(t)} \cdot F_{ex(t-\tau)} \quad (16)$$

where $F_{ex}$=quantity of the exhaust gas $X_{CO}$=CO concentration in the exhaust gas $X_{CO_2}$=$CO_2$ concentration in the exhaust gas $X_{N2}$=$N_2$ concentration in the exhaust gas $X_{O2}$=$O_2$ concentration in the exhaust gas $\tau$=analysis lag time of gas analyzer t=arbitrary time $X_{N2}$ may be measured directly or, where $N_2$ analyzer is unavailable, calculated by deducting the concentrations of CO, $CO_2$, $O_2$, $H_2$, Ar and so on from the whole exhaust gas. Some non-combustion type BOF emission control systems constantly blow the purging $N_2$ gas into the fume. In such cases, the quantity of the purging $N_2$ should be measured beforehand and deducted from $F_{N2}$ in equation (15).

The rate at which the charged fluxes are decomposed cannot be measured directly. So mathematical expression for this reaction should allow for some dead and lag time. The relationship between the dead and lag time is as shown in FIG. 1, in which $l_1$=dead time in decomposition following the start of flux charging $d_1$=lag time in decomposition following the start of flux charging $l_2$=dead time in decomposition following the completion of flux charging $d_2$=lag time in decomposition following the completion of flux charging The curve showing a change in the oxygen content in slag ($O_S$) can be obtained by integrating the $dO_S$, derived from equation (9), as shown in equation (10).

One of the features of this invention is to predetermine a target curve for the change in the oxygen content in slag during a blow (hereinafter called the target curve). This target curve should be determined for each furnace since it varies depending upon equipment specifications and operating conditions.

The target curve can be determined by several methods, some of which are given below, taking into account the conditions concerning the hot metal, blow-out, and so on.

A first method is to select out of the curves for the past blows one that entailed the most desirable result.

A second method is to select out of the past curves hitting the target composition one that entailed the minimum cost.

A third method is to determine the target curve statistically or theoretically, investigating the relationship between the curves for the past blows and the end-point compostion.

The silicon contained in hot or cold pig has a great effect on the in-slag oxygen content curve. So it is preferable to pre-deduct the oxygen that combines with such silicon to form $SiO_2$. Accordingly, correction should be made for silicon in establishing the target curve. At any rate, the target oxygen content in slag should be determined for each blow, based on the charging and blow-out conditions and similar blowing patterns in the past.

Figure 2:
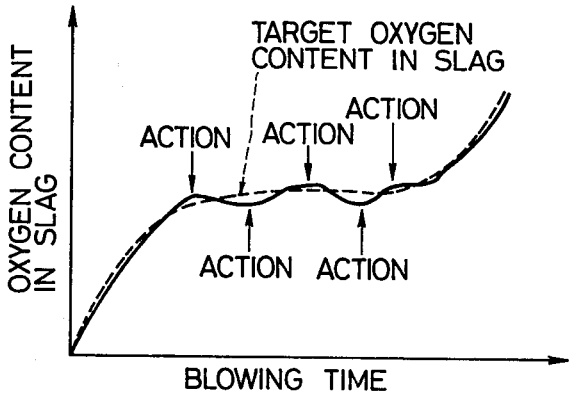
FIG. 2 graphically explains the follow-up control of the oxygen content in slag along a target curve.
Figure 3:
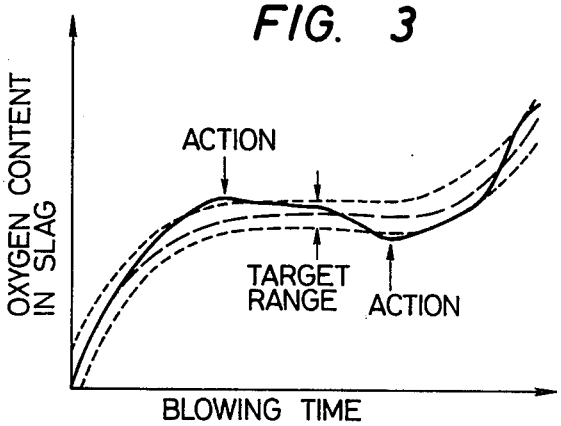
FIG. 3 is a graphical representation of a follow-up control in which the targeted oxygen content in slag has a certain range of allowance.
Figure 4A:
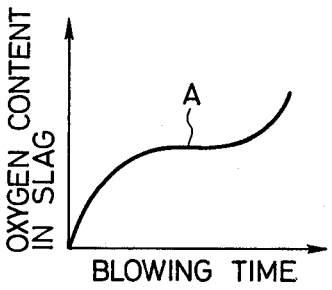
FIGS. 4(*a*), (*b*), (*c*) and (*d*) show a curve of a targeted oxygen content in slag, a curve of the actual oxygen content in slag resulting from the application of the follow-up control according to this invention, and two curves in examples wherein no such control was conducted, respectively.
Figure 4B:
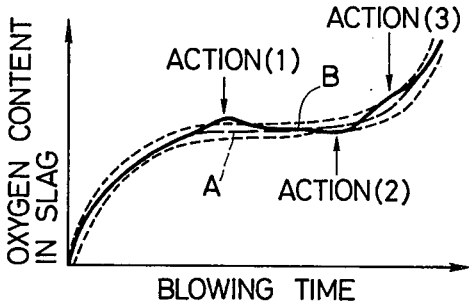
Figure 4C:
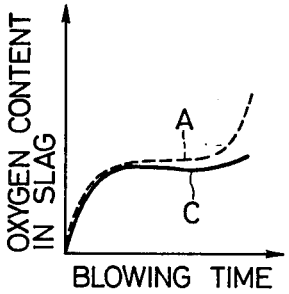
Figure 4D:
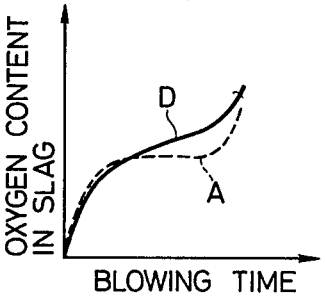

To make the actual oxygen content in slag during blowing conform to the predetermined target curve, the lance level (or the distance between the lance and bath surface), the quantity of oxygen, carbon dioxide and/or inert gas, and the charging rate of fluxes should be controlled as shown in FIG. 2. The range and effect of each control will be discussed later. Or, the control may be conducted in such a manner that the actual oxygen content falls within an allowance zone provided along the target curve as shown in FIG. 3. Calling for fewer adjustments this method is more practical. The following are some examples of the methods by which such control can be accomplished; any of them may be picked up or two or more of them may be used jointly.

First, an automatic control based on the instructions from a computer that performs the computations mentioned before.

Second, a manual control based on the instructions from a computer that performs the computations mentioned before.

Third, a manual control based on the operator's judgement, which in turn is based on the information supplied from a computer.

Preferably, the target curve, allowance zone and actual in-slag oxygen content during blowing should be graphically shown in the screen of a cathode-ray tube. Especially, the third method is impracticable without the graphic display of the blowing condition.

The oxygen content in slag $O_S$ can be controlled by adjusting the lance height and the quantity of oxygen, carbon dioxide and/or inert gas supplied, and adding iron ore or other fluxes. Priority may vary depending on the equipment, operating and other conditions.

The following describes the characteristics and restrictive conditions of each control means, with restrictive conditions and control priorities in actual operations implemented on a 170-ton furnace.

(Control Means—Characteristics and Restrictions)

(1) Lance Level

Because of the heat load on the lance nozzle, the lance cannot be lowered below a certain point.

Because the tip of the lance nozzle lies below the furnace mouth, the lance cannot be raised above a certain point.

Since the bath level is not measured for each heat, it is impossible to know the exact distance between the lance and bath surface. On a certain 170-ton furnace, the lance level was controllable over a range of 1000 mm between 1500 mm and 2500 mm above the bath surface.

$$dO_S = \pm 2500\ Nm^3/hr$$

(2) Quantity of Oxygen Supplied

There is an upper limit because of the equipment-induced restrictions (such as the pressure limit on the oxygen piping and the suction capacity of the exhaust gas disposal system).

Blowing time changes since the total oxygen requirement for a blow remains constant.

Although the continued blowing necessitates a lower limit, a wide range of control is possible. On a certain 170-ton furnace, the quantity of oxygen supply was controllable over a range of 20,000 $Nm^3/hr$ between 10,000 and 30,000 $Nm^3/hr$.

$$dO_S = \pm 5000\ Nm^3/hr$$

(3) Quantity of Carbon Dioxide or Inert Gas Supplied

There is an upper limit because of the equipment-induced restrictions (such as the pressure limit on the carbon dioxide or inert gas piping and the suction capacity of the exhaust gas disposal system)

The need to prevent the inflow of hot metal into the bottom gas tuyeres necessitates setting a lower limit. On a certain 170-ton furnace, the quantity of carbon dioxide or inert gas was controllable over a range of 2000 $Nm^3/hr$ between 1000 and 3000 $Nm^3/hr$.

(4) Iron Ore and Other Fluxes

Because the addition of these fluxes lowers the temperature of hot metal, the heat balance in static blend computation calls for setting a lower limit in use.

Controllable only in the direction in which $O_S$ increases.

It is possible to increase the $O_2$ per unit time to a great extent. It is possible to control the $dO_2$ by varying the charging rate. On a certain 170-ton furnace, the quantity of flux addition was controllable within the range of 0 and 120 t/hr.

$$dO_S = +12{,}000\ Nm^3/hr$$

(Control Priorities)

Because of the dynamic control of the hot-metal temperature and carbon content, and blowing time, priority is given to the control of the lance level. But if adequate effect is not obtained, the quantity of oxygen, carbon dioxide and/or inert gas will be controlled, as well.

Toward the end of a blow, there will remain little time after whatever step to change the operating condition has been taken. To make up for this, more extensive control than ordinary should be given in this stage. If the effect still proves insufficient, and if the $O_S$ tends to decrease, add iron ore or other fluxes within the allowable limit of the charge blend. Since the range and effect of control vary with the equipment and operating conditions, the aforesaid ordering of priority should not be taken as fixed, but it may be changed from furnace to furnace.

(Determination of Control Amount—By computer)

Figure 5A:
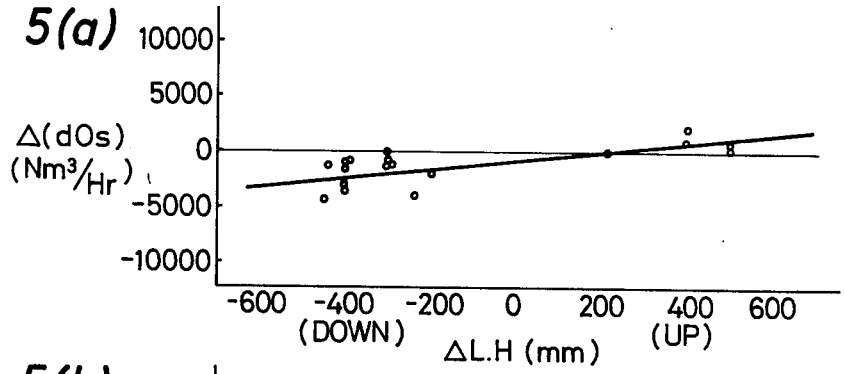
FIGS. 5(*a*), (*b*) and (*c*) show a change in the oxygen content in slag with a change in the lance level, the quantity of oxygen supply, and the speed with which iron ore is charged, respectively.
Figure 5B:
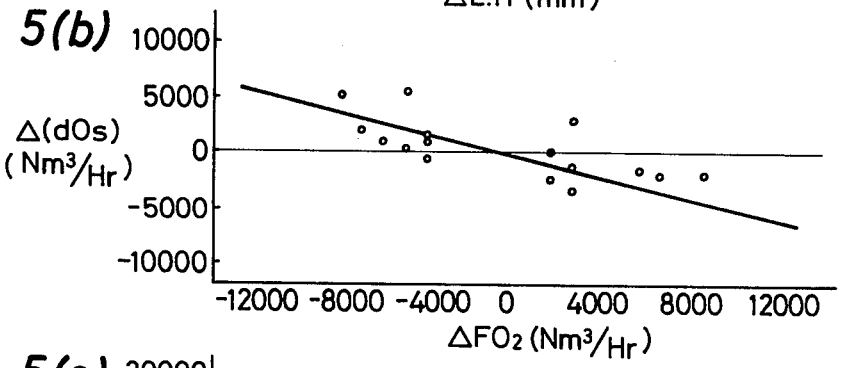
Figure 5C:
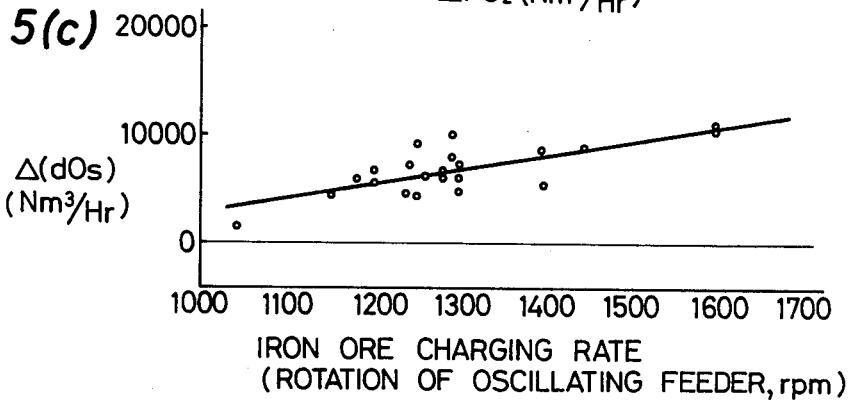
Figure 6A:
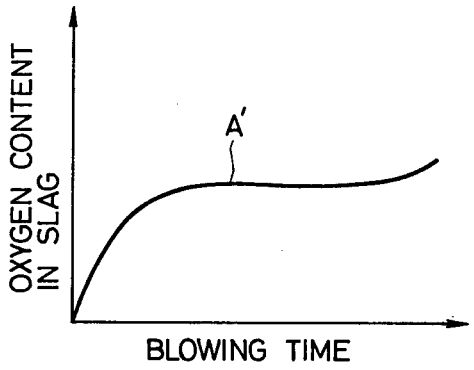
FIGS. 6(*a*), (*b*), (*c*) and (*d*) show a curve of another targeted oxygen content in slag, a curve of the actual oxygen content is slag resulting from the application of the follow-up control according to this invention, and two curves in examples wherein no such control was conducted, respectively.
Figure 6B:
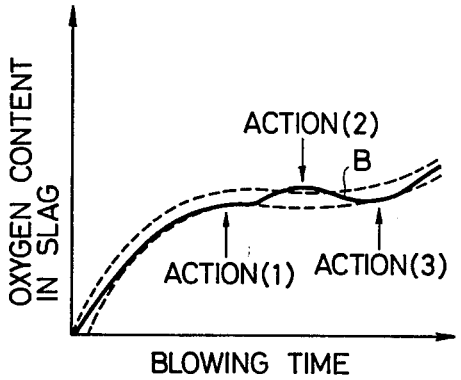
Figure 6C:
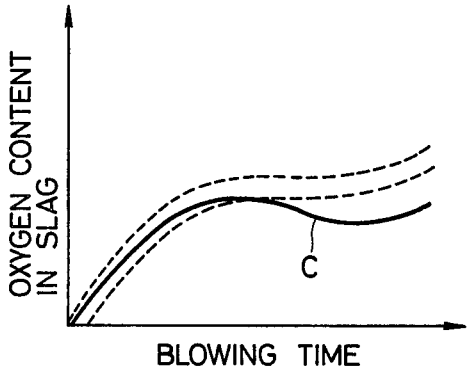
Figure 6D:
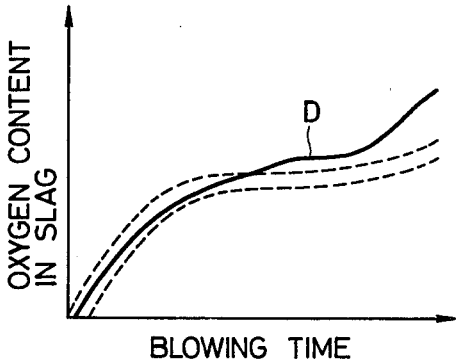

To begin with, the effects of the lance level, quantity of oxygen etc., and iron ore and other fluxes on the $dO_S$ (indicated by the solid lines in FIGS. 5(*a*), (*b*) and (*c*) referred to later) are stored in a computer. (A learning updating function may be provided for each charge.) Then, the amount of control is determined based on the stored effects, and according to the difference between the actual and target $O_S$s. Here, the width of the allowance range (the allowable deviation in $O_S$) should be determined for each furnace, since it varies with the equipment and operating conditions. In the 170-ton furnace mentioned before, the width of the allowance zone was set at 100 $Nm^3$, which is equivalent to the total Fe content in slag $\pm 2$ percent, while keeping constant the quantity of carbon dioxide or inert gas supplied. When the $O_S$ gets out of this range, the lance level is adjusted within the range of $\pm 100$ mm, and the rate of oxygen supply within the range of $\pm 1000\ Nm^3/hr$. If the $O_S$ does not fall within the allowance range, another adjustment is made within the allowable limits.

The following describes the effects which resulted from the above-described control methods of this invention applied to the 170-ton furnace.

(170-ton Furnace, with Oxygen Blown from Above Only)

Out of the in-slag oxygen content curves for 40 heats in the past, one suited for the 170 ton furnace in question was selected as the target curve, as indicated by A in FIG. 4(*a*). The curve B in FIG. 4(*b*) resulted from the application of this invention. This invention was not applied to the operations represented by the curves C and D in FIGS. 4(*c*) and (*d*). Table 1 shows the chemical composition etc. resulted from the blows represented by the curves A to D in FIGS. 4(*a*) thorugh (*d*).

TABLE 1

| | Results | | | | | | |
|---|---|---|---|---|---|---|---|
| | End-point Composition (%) | | | | T.Fe in | | |
| Blow | C $\times 10^{-2}$ | Mn $\times 10^{-2}$ | P $\times 10^{-3}$ | S $\times 10^{-3}$ | slag (%) | Condition | End-point $O_s$ Index |
| A | 8 | 21 | 16 | 17 | 15.2 | Target curve | 1.00 |
| B | 7 | 20 | 15 | 18 | 15.5 | Good | 1.05 |
| C | 9 | 23 | 32 | 20 | 10.7 | poor Slopping | 0.69 |
| D | 8 | 10 | 12 | 20 | 19.7 | Slopping toward the end of middle stage of blow | 12.6 |

The "total Fe in slag" in Table 1 is the ratio in percent of the total weight of the iron contained in the form of FeO or $Fe_2O_3$ to the total weight of slag. The appropriate value of the total Fe content differs with the kind of steel to be produced, the type of furnace, whether or not the furance is bottom-blown, and other conditions. The one in this example was in the vicinity of 15 percent. When this percentage is too large, slag loses its viscosity, thereby becoming likely to form, causing slopping, and lowering the iron-to-steel yield. When it is too small, slagging does not take place in a satisfactory manner, whereby the reactivity of slag drops and, especially, effective dephosphorization is hampered.

To obtain the result shown in FIG. 4(*b*), the computer calculated the values of $dO_S$ and $O_s$ receiving an input of exhaust gas information every two seconds. The following actions (1) to (3) were taken for control. The data which resulted from each action are shown in Table 2.

Action (1)

Since the $O_S$ exceeded the upper limit during the middle stage of the blow, the lance level was lowered by 100 mm from 1850 mm to 1750 mm above the bath surface.

Action (2)

Because the $O_S$ then dropped below the lower limit the lance level was raised by 100 mm from 1750 mm to 1850 mm above the bath surface.

Action (3)

Because the $O_S$ rose beyond the upper limit again toward the end of the blow, the lance level was lowered from 1850 mm to 1550 mm.

TABLE 2

| | Description | | | | |
|---|---|---|---|---|---|
| Action | Target $O_S$ | Upper Limit of $O_S$ | Lower Limit of $O_S$ | Actual $O_S$ | Contents of Control |
| Action (1) | 1040 $Nm^3$ | 1140 | 940 | 1142 | Lance level lowered by 100 mm |
| Action (2) | 1040 | 1140 | 940 | 938 | Lance level raised by 100 mm |
| Action (3) | 1305 | 1405 | 1205 | 1406 | lance level lowered by 300 mm |

When the blow was controlled along the target curve, substantially the same end-point result as targeted was obtained, as evident from FIG. 4(*b*) and Table 1. But in the case of the uncontrolled blow C, the actual oxygen content in slag feel far below the target curve in and after the middle stage of the blow, as shown in FIG. 4(*c*). The results were poor slagging and a high phosphorus content at the end point. In another uncontrolled blow D, the actual oxygen content in slag rose far above the target curve in and after the middle stage of the blow, as shown in FIG. 4(*d*). It caused slopping toward the end of the middle stage. While the phosphorus content was low, the resultant slag was unfavorable with low maganese content and high total Fe content.

Controlling along the target curve permits realizing an optimum blow. FIG. 5 shows the predetermined effects which the control of the lance height, quantity of oxygen, carbon dioxide and/or inert gas, and rate of flux charge are supposed to have on the change in the in-slag oxygen content. FIG. 5(*a*) shows a change in the oxygen content according to a change ($\Delta$L.H) in the lance height. FIG. 5(*b*) shows a change in the oxygen content according to a change ($\Delta FO_2$) in the quantity of oxygen supplied. FIG. 5(*c*) shows a change in the oxygen content according to a change in the rate with which iron ore is charged. As seen in FIG. 5, the oxygen content in slag can be raised by raising the lance level, decreasing the quantity of oxygen supply, and increasing the charging rate of iron ore. Conversely, the in-slag oxygen content can be lowered by lowering the lance level, increasing the quantity of oxygen supply, and decreasing, or stopping, the charging of iron ore. The functional relation shown in FIG. 5 is referred to when determining the desired lance level, oxygen supply and iron ore charging rate from the difference between the estimated in-slag oxygen content (equation (10)) and the target value A' (FIG. 4(*a*)) at each time point. The computer calculates the amount of correction needed for each factor according to this functional relation.

The following describes an example in which the same control was applied to a 1-ton pilot furnace top- and bottom-blown with pure oxygen. The specifications of the furnace are as follows:

| | |
|---|---|
| No. of tuyeres in the bottom: | 3 |
| Quantity of bottom-blown oxygen: | 16 $Nm^3$/hr |
| Quantity of top-blown oxygen: | 150 $Nm^3$/hr |
| Type of tuyeres: | Single pipe type |

Table 3 shows the results of the tests conducted on the furnace.

TABLE 3

| | Description | | | | | | | |
|---|---|---|---|---|---|---|---|---|
| Steel type and Control Method | N Number | [P] $\times 10^{-3}$ (%) $\bar{x}$ | [P] $\times 10^{-3}$ (%) $\sigma$ | [Mn] $\times 10^{-3}$ (%) $\bar{x}$ | [Mn] $\times 10^{-3}$ (%) $\sigma$ | (T.Fe) (%) $\bar{x}$ | (T.Fe) (%) $\sigma$ | Basicity of Charge |
| Low Carbon | | | | | | | | |

TABLE 3-continued

| Steel type and Control Method | N Number | [P] × $10^{-3}$ (%) $\bar{x}$ | [P] × $10^{-3}$ (%) $\sigma$ | [Mn] × $10^{-3}$ (%) $\bar{x}$ | [Mn] × $10^{-3}$ (%) $\sigma$ | (T.Fe) (%) $\bar{x}$ | (T.Fe) (%) $\sigma$ | Basicity of Charge |
|---|---|---|---|---|---|---|---|---|
| Conventional | 76 | 19.7 | 6.0 | 19.9 | 2.2 | 11.6 | 3.1 | 3.64 |
| This Invention | 38 | 16.7 | 2.5 | 21.2 | 2.0 | 10.8 | 1.4 | 3.61 |
| Medium Carbon | | | | | | | | |
| Conventional | 22 | 32.1 | 8.9 | 26.8 | 3.1 | 7.2 | 2.8 | 3.61 |
| This Invention | 16 | 24.1 | 3.7 | 27.5 | 2.8 | 8.0 | 1.9 | 3.65 |

When oxygen is blown from both above and below, the quantity of bottom-blown oxygen has a great effect on the $O_S$, so the control priorities were arranged in the order of (1) the quantity of bottom-blown oxygen, (2) the lance level, and (3) the quantity of top-blown oxygen. As the quantity of bottom-blown oxygen is increased, the increase rate of the $O_S$ drops, and vice versa.

Obviously, application of this invention to a furnace top- and bottom-blown with oxygen produces the same results as with the top-blown one. That is, variation decreases remarkably in not only the total Fe content but also the phosphorus and manganese contents.

Then, operation proceeds to the end-point control after making a sublance measurement when the oxygen content reaches a quantity predetermined by static control. The following is a brief description of the conventional end-point control.

Midway in the blow, the decarburizing efficiency and the oxygen content in slag are computed from the temperature and carbon content (intermediate) of hot metal and the chemical analysis and quantity of exhaust gas measured by the sublance. Then, the hot-metal temperature and carbon content at the end point are estimated, and control (hereinafter called the first control means) is made according to their deviation from the target values. But the target-hitting rate of this method is low since errors in the measurement of exhaust gas and the detection of said intermediate values are carried over the end point intact.

There is also another method that expresses the efficiency of the blow only in terms of the decarburizing reaction (or the decarburizing efficiency of oxygen) derived from the exahust gas information. But this method too is heavily affected by the error in the measurement of exhaust gas. Besides, the end-point condition is not so simple as to be expressed only in terms of the decarburizing reaction.

Still another method proposes to express the blowing condition in terms of the decarburizing reaction, and compute the coefficients in the expression for that reaction based on the data for the past charges. but this method cannot reflect a change in the reaction during the blow. In addition, as with the preceding method, the decarburizing reaction is not enough to express the end-point condition.

One of the features of the end-point control according to this invention is that the exhaust gas information is filtered. The chemical composition and quantity of exhaust gas derived from the actual process contain not only their signals but also some noise signals. So any values computed based on such information contain considerable errors. This information increases the accuracy of the control by filtering the base infomation.

Another feature lies in that the end-point condition is expressed in terms of the decarburizing efficiency of oxygen, in oxygen content in slag, and the temperature of hot metal. Addition of the slag-based information enables more accurate estimation of the end-point condition than the conventional methods based on the decarburizing efficiency and hot-metal temperature alone.

Equation (17) formulates the ratio of decarburizing rate to oxygen supply according to this invention.

$$-\frac{dc}{do_2} = \alpha_1\left\{1 - E \times P\left(\frac{C - \alpha_3}{\alpha_2}\right)\right\} \tag{17}$$

Equation (18) expresses the ratio of in-slag oxygen content to oxygen supply $$\frac{dO_S}{dO_2} = \delta_1 + \delta_2\frac{dc}{dO_2} \tag{18}$$

Equation (19) gives the ratio of hot-water temperature increase to oxygen supply $$\frac{dT}{dO_2} = \beta_1\frac{dc}{dO_2} + \beta_2\frac{dO_S}{dO_2} \tag{19}$$

In these equations, $\delta_1$=decarburizing, slagging coefficient 1

$\delta_2$=decarburizing, slagging coefficient 2

$dc/dO_2$=decarburizing efficiency of oxygen $dO_S/dO_2$=efficiency of oxygen content in slag $dT/dO_2$=ratio of hot-metal temperature increase to oxygen supply $\alpha_1$=maximum ratio of decarburizing rate to oxygen supply $\alpha_2$=coefficient of the ratio of decarburizing rate to oxygen supply $\alpha_3$=minimum blowable carbon content (constant)

$\beta_1$=decarburizing, temperature increase coefficient $\beta_2$=slagging, temperature increase coefficient Then, the final value of the ratio $-dc/dO_2$ is estimated by applying Kalman filter to the ratios of decarburizing rate and in-slag oxygen content to oxygen supply ($-dc/dO_2$ and $dO_2/dO_2$) derived, according to equations (17) and (18), from the exhaust gas information obtained during the blow, using the predetermined $\alpha_1$ and $\alpha_2$ as initial values and starting with the start of sublance measuring. Thus, the value of $\alpha_2$ for the blow in question is determined, and the temperature and carbon content of hot metal at the end point are estimated by computation.

When there arises any deviation from the target temperature and carbon content, such steps are taken to eliminate the difference as raising or lowering the lance, changing the quantity of blown oxygen, and/or adding fluxes.

Table 4 exemplifies the relationship between the control to follow up the target curve representing the change in the in-slag oxygen content and one that eliminates the deviation from the target hot metal temperature and carbon content.

TABLE 4

| Estimated End-point Temperature | Actual $O_S$ via Target $O_S$ | | |
|---|---|---|---|
| | Lower $O_S$ | Hitting Target $O_S$ | Higher $O_S$ |
| Lower Temperature | Raise lance level | Raise lance level (resulting increase in $O_S$ neglected) | Raise lance level (resulting increase is $O_S$ neglected) |
| Fitting Target Temperature | Raise lance level and add coolant | No control given | No control given |
| Higher Temperature | Raise lance level and add coolant | Add coolant | Lower lance level and add coolant |

To eliminate the $O_S$ and temperature deviation on the lower side, the lance level should be raised among other things. The resulting temperature deviation on the higher side is compensated for by adding coolant, and the resulting $O_S$ deviation on the higher side is neglected.

The following describes an example in which oxygen was blown from the top and carbon dioxide from the bottom.

(170-ton Furnace Blown with a Constant Quantity of Carbon Dioxide)

Out of the in-slag oxygen content curves for 40 heats in the past, one suited for the 170-ton furnace in question was selected as the target curve, as indicated by A' in FIG. 6(*a*). The curve B in FIG. 6(*b*) resulted from the application of this invention. This invention was not applied to the operations represented by the curves C and D in FIGS. 6(*c*) and (*d*). Table 5 shows the chemical composition etc. at the end point resulted from the blows represented by the curves A' to D in FIGS. 6(*a*) through (*d*).

TABLE 5

| Blow | Results | | | | | | |
|---|---|---|---|---|---|---|---|
| | End-point composition (%) | | | | T.Fe in slag (%) | Condition | End-point $O_S$ Index |
| | $0 \times 10^{-2}$ | $Mn \times 10^{-2}$ | $P \times 10^{-3}$ | $S \times 10^{-3}$ | | | |
| A | 8 | 25 | 18 | 17 | 12.2 | Target curve | 1.00 |
| B | 7 | 24 | 17 | 18 | 12.5 | Good | 1.05 |
| C | 9 | 27 | 34 | 20 | 7.7 | poor slagging | 0.69 |
| D | 8 | 15 | 14 | 20 | 16.7 | Slopping toward the end of middle stage of blow | 1.26 |

To obtain the results shown in FIG. 6(*b*), the computer calculated the values of $dO_S$ and $O_S$ receiving an input of exhaust gas information every two seconds. The following actions (1) to (3) were taken for control. The data resulted from each action are shown in Table 6.

Action (1)

Since the $O_S$ dropped below the lower limit during the middle stage of the blow, the lance level was raised by 100 mm from 1850 mm to 1950 mm above the bath surface.

Action (2)

Because the $O_S$ then exceeded the upper limit, the lance level was lowered by 100 mm from 1950 mm to 1850 mm.

Action (3)

Because the $O_S$ exceeded the upper limit toward the end of the blow, the lance level was raised from 1850 mm to 2150 mm.

TABLE 6

| Action | Description | | | | |
|---|---|---|---|---|---|
| | Target $O_S$ | Upper limit of $O_S$ | Lower Limit of $O_S$ | Actual $O_S$ | Contents of Control |
| Action (1) | 720 $Nm^3$ | 820 | 620 | 618 | Lance level raised by 100 mm |
| Action (2) | 760 | 860 | 660 | 861 | Lance level lowered by 100 mm |
| Action (3) | 1040 | 1140 | 940 | 938 | Lance level raised by 300 mm |

When the blow was controlled along the target curve, substantially the same end-point result as targeted was obtained, as evident from FIG. 6(*b*) and Table 5. But in the case of the uncontrolled blow C, the actual oxygen content in slag fell far below the target curve in and after the middle stage of the blow, as shown in FIG. 6(*c*). The results were poor slagging and a high phosphorus content at the end point. In another uncontrolled blow D, the actual oxygen content in slag rose far above the target curve in and after the middle stage of the blow, as shown in FIG. 4(*d*). It caused slopping toward the end of the middle stage, as in the case of the preceding example in which oxygen was blown from the bottom. This time against the resultant slag was unfavorable with low manganese content and high total Fe content, despite the low phosphorus content.

Figure 7A:
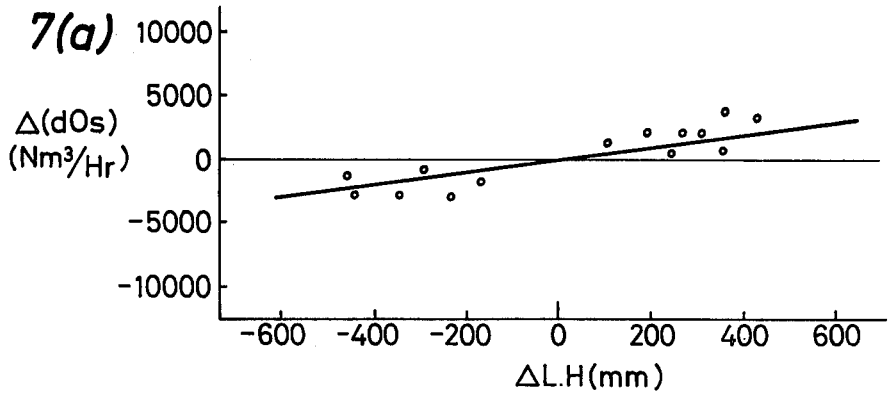
FIGS. 7(*a*), (*b*) and (*c*) respectively show a change in the oxygen content in slag with a change in the lance level, the quantity of oxygen supply, and the speed with which iron ore is charged in another embodiment of this invention.
Figure 7B:
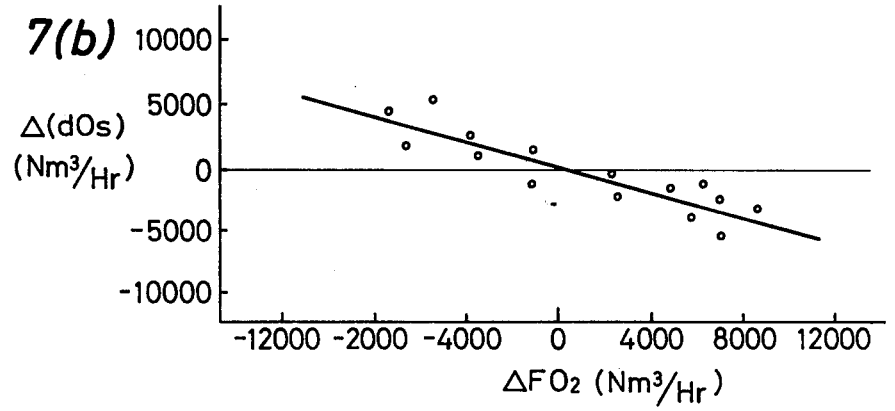
Figure 7C:
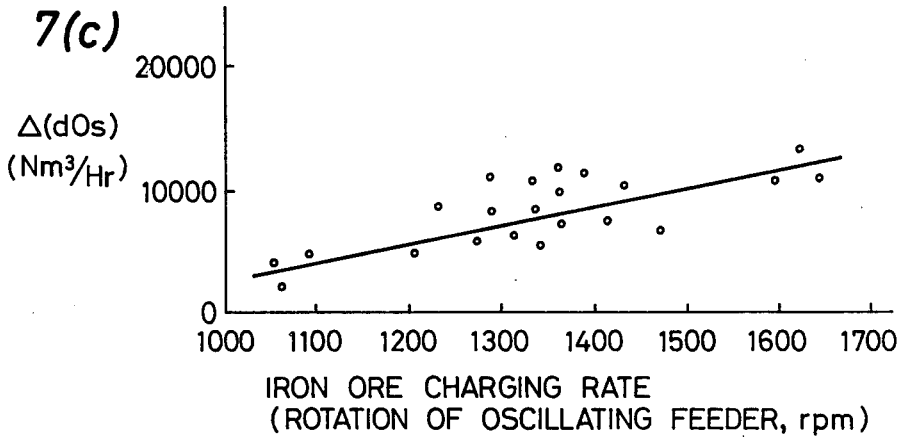

Controlling along the target curve permits realizing an optimum blow. FIG. 7 shows the predetermined effects which the control of the lance level, quantity of oxygen, carbon dioxide and/or inert gas, and rate of flux charge are supposed to have on the change in the in-slag oxygen content. FIG. 7(*a*) shows a change in the oxygen content according to a change (ΔL. H) in the lance level. FIG. 7(*b*) shows a change in the oxygen content according to a change ($\Delta FO_2$) in the quantity of oxygen supplied. And FIG. 7(*c*) shows a change in the oxygen content according to a change in the rate with which ore is charged. As seen in FIG. 7, the oxygen content in slag can be raised by raising the lance level, decreasing the quantity of oxygen supply, and increasing the charging rate of iron ore. Conversely, the in-slag oxygen content can be lowered by lowering the lance level, increasing the quantity of oxygen supply, and decreasing, or stopping, the charging of iron ore. The functional relation shown in FIG. 7 is referred to when determining the desired lance level, oxygen supply and iron ore charing rate from the difference between the estimated in-slag oxygen content (equation (10)) and the target value A' (FIG. 6(*a*)) at each time point. The computer calculates the amount of correction needed for each factor according to this functional relation.

The following describes an example in which the same control was applied to a 1-ton pilot furnace top-blown with pure oxygen and bottom-blown with carbon dioxide. The specifications of the furnace are as follows:

| | |
|---|---|
| No. of tuyeres in the bottom: | 3 |
| Quantity of bottom-blown $CO_2$: | 16 $Nm^3/hr$ |
| Quantity of top-blown $O_2$: | 150 $Nm^3/hr$ |
| Type of tuyers: | Single tube-type |

Table 7 shows the results of the tests conducted on the furnace.

TABLE 7

| Steel type and control Method | N Number | Description [P] × $10^{-3}$ (%) $\bar{x}$ | $\sigma$ | [Mn] × $10^{-2}$ (%) $\bar{x}$ | $\sigma$ | [T.Fe] (%) $\bar{x}$ | $\sigma$ | Basicity of charge |
|---|---|---|---|---|---|---|---|---|
| Low Carbon | | | | | | | | |
| Conventional | 41 | 18.9 | 5.8 | 19.2 | 2.5 | 12.6 | 3.2 | 3.64 |
| This Invention | 33 | 16.2 | 2.7 | 22.3 | 2.0 | 11.9 | 1.5 | 3.62 |
| Medium Carbon | | | | | | | | |
| Conventional | 27 | 30.5 | 7.6 | 25.7 | 3.3 | 7.8 | 3.0 | 3.62 |
| This Invention | 25 | 23.3 | 3.2 | 26.1 | 2.7 | 8.6 | 1.8 | 3.65 |

Then, as with the previous example, operation proceeds to the end-point control after making a sublance measurement when the oxygen content reaches a quantity predetermined by static control. Likewise, the temperature and carbon content of hot metal at the end point are estimated using equations (17) through (19).

When there arises any deviation from the target temperature and carbon content, such steps are taken to eliminate the difference as raising or lowering the lance, changing the quantity of blown oxygen, and/or adding fluxes. Also, the same relationship as shown in Table 4 prevails between the control to follow up the target curve representing the change in the in-slag oxygen content and one that eliminates the deviation from the target hot metal temperature and carbon content.

The following describes an example in which oxygen is top-blown and an inert gas is bottom-blown.

Unlike oxygen and carbon dioxide, the inert gas blown from the bottom does not react with the carbon in steel, and, therefore, no carbon monoxide is generated. Accordingly, stable agitation continues from the beginning to the end of a blow, irrespective of carbon concentration. The fact that the blown gas hardly reacts with the components of the hot metal points to the absence of both exothermic and endothermic reactions. So the tuyeres are only cooled by the sensible heat of the blown-in gas, causing no erosion nor clogging.

The following describes an example in which oxygen was top-blown and argon was bottom-blown, as an inert gas, into a 1-ton pilot furnace.

The specifications of the furnace are as follows:

| | |
|---|---|
| No. of tuyeres in the bottom: | 3 |
| Quantity of bottom-blown argon: | 5 $Nm^3/hr$ |
| Quantity of top-blown oxygen: | 150 $Nm^3/hr$ |
| Type of tuyere: | Single tube type |

The results of the tests are shown in Table 8. The methods and priorities of the controls employed are the same as with the preceding case in which carbon dioxide was bottom-blown.

TABLE 8

| Steel Type and Control method | N Number | Description [P] × $10^{-3}$ (%) $\bar{x}$ | $\sigma$ | [Mn] × $10^{-2}$ (%) $\bar{x}$ | $\sigma$ | [T.Fe] (%) $\bar{x}$ | $\sigma$ | Basicity of charge |
|---|---|---|---|---|---|---|---|---|
| Lower Carbon | | | | | | | | |
| Conventional | 5 | 18.0 | 5.9 | 19.4 | 2.6 | 13.6 | 3.7 | 3.66 |
| This Invention | 5 | 15.7 | 2.7 | 19.5 | 2.1 | 13.5 | 1.9 | 3.63 |
| Medium Carbon | | | | | | | | |
| Conventional | 5 | 27.2 | 7.8 | 24.5 | 2.5 | 9.5 | 3.2 | 3.6 |
| This Invention | 5 | 21.9 | 3.5 | 24.4 | 2.0 | 9.7 | 2.2 | 3.6 |

The following describes an example in which oxygen is top-blown, and a mixture of oxygen and carbon dioxide is bottom-blown.

When oxygen alone is bottom-blown, the tuyeres are likely to erode away. For this reason, double-tube tuyeres are commonly used so that propane or other hydrocarbon-based cooling gases be passed through the outer tube. In this case, the hydrogen content in steel inevitably increases, which inevitably deteriorates the quality of some steels. By contrast, the mixture of oxygen with carbon dioxide or inert gas scarecely erodes the tuyeres, while giving a more powerful atitation to the hot metal. This eliminates the use of cooling gas and, therefore, solves the problem of hydrogen increase in steel.

When carbon dioxide or inert gas alone is blown, the tuyeres are likely to clog. But when they are mixed with oxygen, the tuyeres are held in good shape.

The following describes an example in which control is made according to the oxygen content in slag on a 1-ton pilot furnace top-blown with oxygen and bottom-blown with a mixture of oxygen with carbon dioxide or inert gas.

The specifications of the furnace are as follows:

| | |
|---|---|
| No. of tuyeres in the bottom: | 3 |
| Quantity of bottom-blown mixed gas ($CO_2$: $O_2$ = 4:1): | 16 $Nm^3$/hr |
| Quantity of top-blown oxygen: | 150 $Nm^3$/hr |
| Type of tuyere: | Single-tube type |

The results of the tests are shown in Table 9. The methods and priorities of the controls employed are the same as with the previous case in which carbon dioxide alone was bottom-blown.

TABLE 9

| Steel Tape and Control Method | N Number | Description [P] $\times 10^{-3}$ (%) $\bar{x}$ | [P] $\times 10^{-3}$ (%) $\sigma$ | [Mn] $\times 10^{-2}$ (%) $\bar{x}$ | [Mn] $\times 10^{-2}$ (%) $\sigma$ | (T.Fe) (%) $\bar{x}$ | (T.Fe) (%) $\sigma$ | Basicity of charge |
|---|---|---|---|---|---|---|---|---|
| Low Carbon | | | | | | | | |
| Conventional | 5 | 19.5 | 5.2 | 19.1 | 2.2 | 12.3 | 3.1 | 3.63 |
| This Invention | 5 | 16.4 | 2.2 | 21.4 | 1.9 | 12.7 | 1.5 | 3.64 |
| High Carbon | | | | | | | | |
| Conventional | 5 | 28.6 | 7.1 | 26.4 | 2.9 | 7.9 | 2.7 | 3.67 |
| This Invention | 5 | 22.1 | 3.4 | 24.9 | 2.1 | 8.1 | 1.8 | 3.67 |

The following describes an example in which oxygen is top-blown and a mixture or three or more gases is bottom-blown.

When inert gases Ar, $N_2$ and $CO_2$ are compared in terms of cost, Ar ranks highest and $N_2$ lowest. When $N_2$ is bottom-blown, the $N_2$ content in steel naturally rises. For steels to which the $N_2$ content does not matter, the use of $N_2$ is economical. But it may deteriorate the quallity of some steels. Even with such steels, considerable economy can be achieved by blowing Ar or $CO_2$, or their mixtures with oxygen, when the blow is on, and $N_2$ when the blow is off. This type of on-and-off switch is sometimes practiced.

Another practice is to switch the kind of gas from one to another in the midst of the blow: for example, $O_2$ is mostly used in the early and middle stages of the blow in which the supply of $O_2$ constitutes the rate-determining stage, and a gas mixture mainly comprising $CO_2$ or Ar, for greater agitation, in the later stage where the transfer of C in steel is the rate-determining stage.

In either case, the same control method as before is applied. That is, the control based on the in-slag oxygen content decreases the variation in the phosphorus, mangasese and total Fe contents at the end point.

There are top- and bottom-blown furnaces whose bottom tuyers are of the double-tube structure. With a view to decreasing the tuyere erosion and ensuring smooth blowing, the same gas or different gases are blown through the internal and external tubes of these furnaces. The control according to this invention is applicable to the top- and bottom-blown furnaces of this type, as well.

The following paragraphs describe an embodiment of the apparatus on which the above-described blow control according to this invention is implemented.

Figure 8:
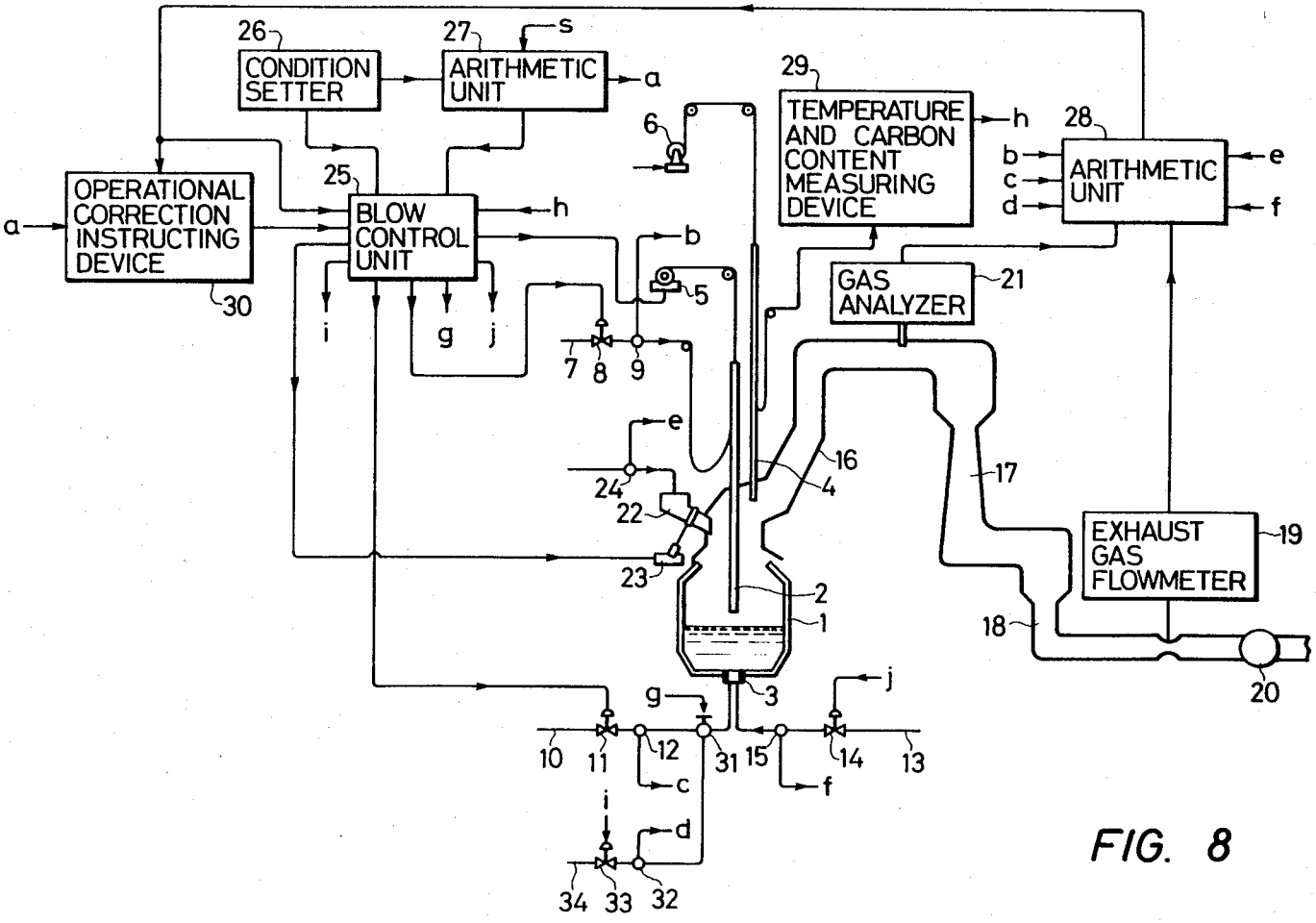
FIG. 8 is a schematic block diagram showing an embodiment of this invention.
Figure 9:
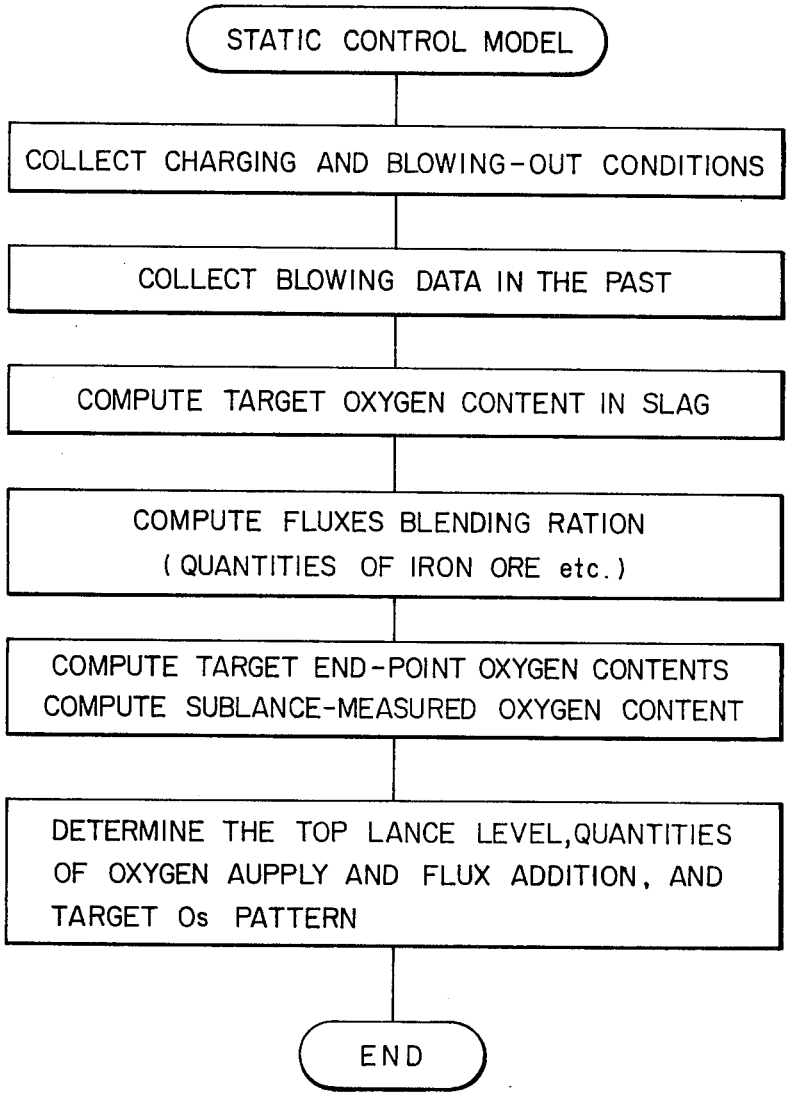
FIG. 9 is a flow chart showing an example of the dynamic control employed by the furnace of this invention.
Figure 10:
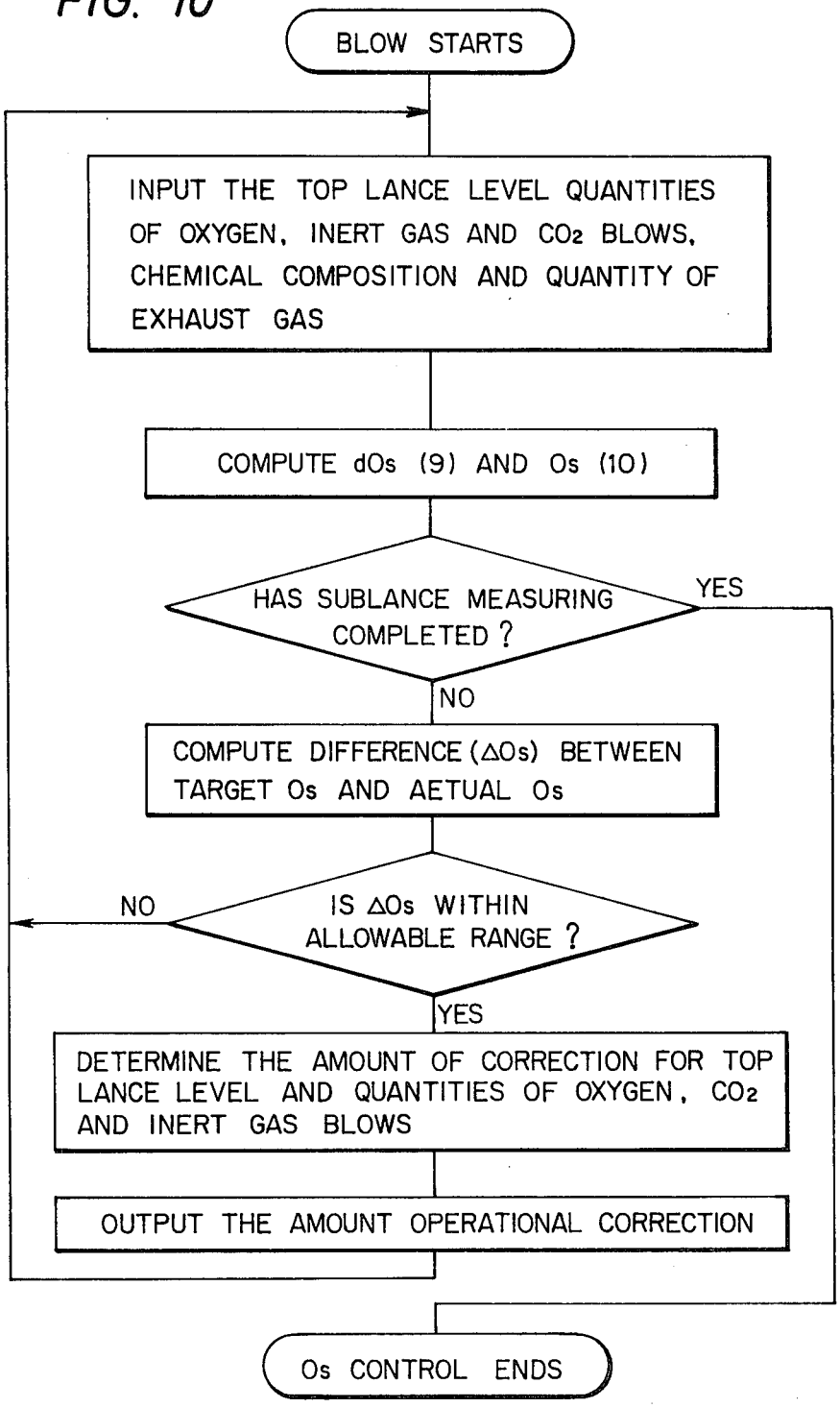
FIG. 10 is a flow chart showing an example of the in-slag oxygen content computing process and blow control according to this invention.
Figure 11:
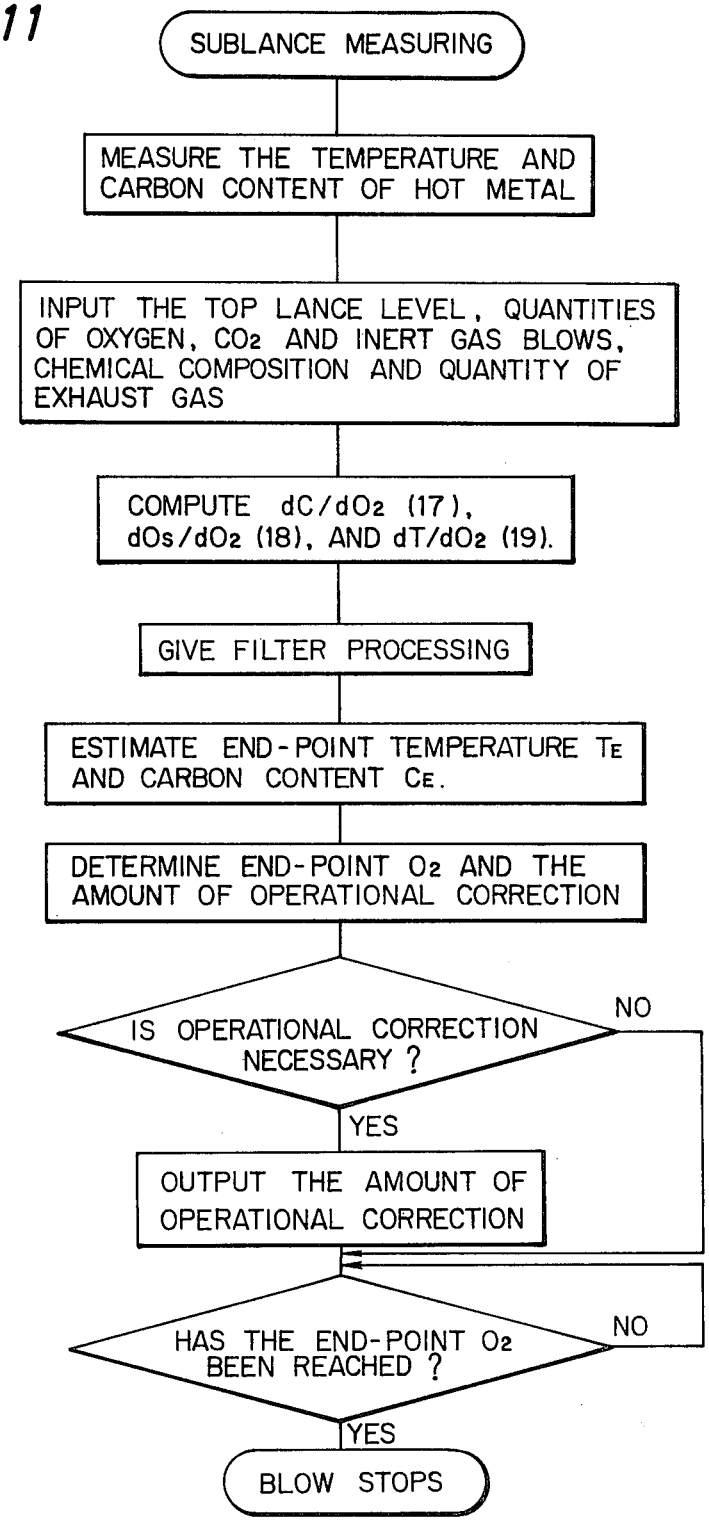
FIG. 11 is a flow chart showing an example of the end-point hot-metal temperature and carbon content computing process according to this invention.

FIG. 8 is a schematic block diagram of an oxygen-blown steelmaking furnace system according to this invention; in which reference numeral 1 designates an oxygen-blown furnace, 2 a top-blowing oxygen lance (hereinafter called the lance), 3 a nozzle through which oxygen, carbon dioxide or inert gas is bottom blown (hereinafter called the bottom nozzle), 4 a sublance carrying, at the tip thereof, a probe for sensing the temperature and carbon content of hot metal, 5 a lance elevating system, 6 a sublance elevating system, 7 oxygen piping connected to an oxygen supply source not shown, 8 a control valve, and 9 an oxygen flowmeter. Reference numeral 10 denotes piping supplying oxygen, carbon dioxide or inert gas from their supply sources, not shown, to the bottom nozzle, with items 11 and 12 being a control valve and a gas flowmeter, respectively. Reference numeral 13 designates cooling gas (or coolant) piping connected to its supply source not shown, with a control valve 14 and a flowmeter 15.

Reference numeral 16 designates an exhaust gas duct, 17 and 18, collectively, a dust collecting mechanism comprising a venturi-type cleaner and so on, 19 an exhaust gas flowmeter, 20 an induced-draft fan, and 21 a gas analyzer. Reference numeral 22 denotes a flux charging chute, 23 a damper, 24 a flux weigher, 25 a blow control unit comprising a computer, and 26 a device for setting charging and blow-out conditions (hereinafter called the condition setter). Item 27 is a base arithmetic unit that calculates, statistically or theoretically, and outputs a continuous change in the target oxygen content in slag, which serves as the reference target for each blow, based on the input signals supplied from the condition setter 26 and an analogous blow pattern (indicated by the arrow S) selected out of the past data by a setter not shown. Item 28 is arithmetic unit that calculates and outputs a change with time in the oxygen content is slag based on the chemical composition and quantity of exhaust gas, the quantity of oxygen blown, the quantity of fluxes added, and the quantity of carbon dioxide or inert gas blown through the bottom nozzle. Item 29 is a temperature and carbon content measuring device that transmits signals concerning the temperature and carbon content of hot metal measured. Reference numeral 30 designates a device to instruct operational correction, 31 a control valve to change the type of the gas blown from below, 32 a gas flowmeter, 33 a control valve, and 34 piping connected to an inert gas supply source not shown.

In this invention, a first unit comprises the top lance 2, bottom nozzle 3, the upper lance elevator 5, the oxygen piping 7, the control valve 8, and the apparatuses for blowing inert and cooling gases. A second unit comprises the exhaust gas duct 16, the dust collecting mechanism 17 and 18, the induced-draft fan 20, and a gas storage tank and flare stack not shown. A third unit comprises the flux charging chute 22, the damper 23, and the flux weigher 24. A fourth unit comprises the sublance 4, the sublance elevator 6, and the temperature and carbon content measuring device 29. A fifth unit comprises the gas analyzer 21. A sixth unit comprises the exhaust gas flowmeter 19. A seventh unit comprises the oxygen flowmeter 9 and the gas flowmeter 12. An eighth unit comprises the blow control unit 25 and the condition setter 26. A ninth unit comprises the base arithmetic unit 27. A tenth unit comprises the oxygen content computing device 28. And an eleventh unit comprises the operational correction instructing device 30.

Referring now to FIGS. 8 through 11, the function and operation of the above-described system will be described.

To start a heat, molten iron is charged into the furnace 1 from a ladle not shown, and then oxygen is blown through the top lance 4. Prior to that, however, carbon dioxide or inert gas is blown through the bottom nozzle 3. In some cases, the carbon dioxide or inert gas blown through the bottom nozzle 3 is changed to other gases the moment the oxygen blow starts. Prior to the start of the blow, the base arithmetic unit 27 computes a target curve representing a change in the oxygen content in slag, based on the input signals from the condition setter 26 and the analogous blow pattern selected from the past operations, and outputs the obtained result to the blow control unit 25. Based on the input from the condition setter 26, the blow control unit 25 determines the quantity of oxygen to be blown, lance level, quantity of carbon dioxide or inert gas to be blown, and quantity of fluxes to be added. Then, the control valves 8, 11 and 14 are opened accordingly, the top lance elevator 5 and, if necessary, the damper 23 are actuated, and the blow is started. More specifically, operating instructions have been given to the second unit including the induced-draft fan 20 and measures to prevent the inert-gas-induced explosion taken before that.

Next, the arithmetic unit 28 outputs the ever-changing information concerning the oxygen content in slag to the blow control unit 25, which, in turn, compares the received data with the curve of the target in-slag oxygen content (the target curve), instructing the operational correction to elimnate any deviation therebetween according to the present order of priority.

To the operational correction instructing device 30 has been inputted the signals concerning the target curve (representing a target change in the in-slag oxygen content) from the base arithmetic unit 27 and the signals concerning the actual oxygen content in slag from the arithmetic unit 28. In it is also preset an oxygen flow rate so that the fourth unit be actuated when the quantity of oxygen blown reaches that level. Furthermore, the signals from the oxygen flowmeter 9 and gas flowmeter 10 are inputted, too. Accordingly, the sublance 4 is actuated to measure the temperature and carbon content of the hot metal when the actual quantity of oxygen blown agrees with the preset value immediately before the completion of the blow. Following this measurement, the operational correction instructing device 30 begins estimating the temperature and carbon content of the hot metal at the end point. When the estimated values have proved to deviate from the targeted ones, signals to reduce or eliminate the difference are given to the blow control device 25. Then, the lance level, quantity of oxygen, carbon dioxide or inert gas blown, and quantity of fluxes added are corrected according to the priorities mentioned previously.

This invention is by no means limited to the above-described examples, but can be embodied in various other ways. For example, the blow control device 25, condition setter 26, base arithmetic unit 27, oxygen content computing unit 28, operational correction instructing unit 30 and so on may be integrated as desired within the range in which no deviation from the object of this invention occurs.

In this invention, the cooling gas is not an essential requirement. It is used only when, for example, the bottom nozzle 3 is of the double-tube structure; i.e. when $CO_2$ is blown through both the internal and external tubes, but at different rates, or when $CO_2$ is blown through the inner tube and Ar through the outer tube. So the function of the cooling gas should be understood as secondary. But the gas blown through the outer tube is called the cooling gas in the embodiment described above only because it serves as a coolant when oxygen is blown through the inner tube.

The system according to this invention is capable of performing an appropriate control or an optimum control using a change in the target oxygen content in slag during the blow which has been impossible with the conventional systems. Accordingly, the system of this invention permits hitting the targets set for not only the temperature and carbon content but also the phosphorus and manganese contents and other properties of hot metal with high precision.

Another features of this invention is to greatly facilitate the end-point control, and also to raise its accuracy remarkably, thanks to the aforesaid optimum control during the blow. All this results in improved target-hitting rate, increased iron-to-steel yield, and lowered production cost in the oxygen-blown furnace operation.

What is claimed is:

1. An oxygen-blown steelmaking furnace which continuously operationally corrects the course of a current programmed hot metal blow based on oxygen content in slag from a preselected prior blow, comprising:

a steelmaking furance;

means for supplying oxygen and fluxes to said furnace from above said furnace;

a plurality of sensing means which continuously detect changes in properties representing charging and blowing out conditions for said current blow, said properties including kinds of fluxes, quantities and charging speed thereof, quantity of flow of top-blown oxygen, lance level, and quantity of flow and composition of exhaust gas; and computer control means for:

A. setting a program for said current blow based on said charging and blowing out conditions, B. continuously computing oxygen content in slag produced during said current blow based on said charging and blowing out conditions, C. continuously computing the difference between:

i. said oxygen content in slag produced during said current blow, and ii. said oxygen content in slag from said preselected prior blow, D. outputting operational instructions based on said difference to said supplying means to effect said operational correction, and E. estimating temperature and carbon content in said hot metal substantially immediately prior to completing said current blow and determining any additional amount of said operational correction based thereon.

2. The furnace of claim 1 wherein said oxygen content in slag for said current blow is determined according to the expression:

$$dO_S = F_{OX} + F_{CO_2}iP + \Sigma(\alpha_i + \beta_i + \tfrac{1}{2}\cdot\gamma_i)\cdot W_{Fi}^* - (\tfrac{1}{2}F_{CO}E + F_{CO_2}E)$$

where $$O_S = \int_{t_1}^{t_2} (dO_S)\cdot dt$$

and where $F_{OX}$=quantity of pure oxygen blown $F_{CO}E$=quantity of CO produced in the furnace $F_{CO_2}E$=quantity of $CO_2$ produced in the furnace $W_{Fi}^*$=rate at which flux i is decomposed in the furnace $\alpha_i$=coefficient with which flux i generates $O_2$ $\beta_i$=coefficient with which flux i generates $CO_2$ $\gamma_i$=coefficient with which flux i generates $H_2O$ $dO_S$=change in the oxygen content is slag $O_S$=oxygen content in slag t=time $F_{CO_2}iP$=quantity of carbon dioxide, but when inert gas is used $F_{CO_2}iP=0$ 3. An oxygen-blown steelmaking furnace which continuously operationally corrects the course of a current programmed hot metal blow based on oxygen content in slag from a preselected prior blow, comprising:

a steelmaking furnace;

means for supplying oxygen and fluxes to said furnace from above said furnace;

means for supplying at least one of oxygen, carbon dioxide, and inert gas to said furnace from below said furnace;

a plurality of sensing means which continuously detect changes in properties representing charging and blowing out conditions for said current blow, said properties including kinds of fluxes, quantities and charging speed thereof, quantity of flow of top-blown oxygen, lance level, and quantity of flow and composition of exhaust gas; and computer control means for:

A. setting a program for said current blow based on said charging and blowing out conditions, B. continuously computing oxygen content in slag produced during said current blow based on said charging and blowing out conditions, C. continuously computing the difference between:

i. said oxygen content in slag produced during said current blow, and ii. said oxygen content in slag for said preselected prior blow, D. outputting operational instructions based on said difference to said supplying means to effect said operational correction, and E. estimating temperature and carbon content in said hot metal substantially immediately prior to completing said current blow and determining any additional amount of said operational correction based thereon.

4. The furnace of claim 3 wherein said oxygen content in slag for said current blow is determined according to the expression:

$$dO_S = F_{OX} + F_{CO_2}iP + \Sigma(\alpha_i + \beta_i + \tfrac{1}{2}\cdot\gamma_i)\cdot W_{Fi}^* - (\tfrac{1}{2}F_{CO}E + F_{CO_2}E)$$

where $$O_S = \int_{t_1}^{t_2} (dO_S)\cdot dt$$

and where $F_{OX}$=quantity of pure oxygen blown $F_{CO}E$=quantity of CO produced in the furnace $F_{CO_2}E$=quantity of $CO_2$ produced in the furnace $W_{Fi}^*$=rate at which flux i is decomposed in the furnace $\alpha_i$=coefficient with which flux i generates $O_2$ $\beta_i$=coefficient with which flux i generates $CO_2$ $\gamma_i$=coefficient with which flux i generates $H_2O$ $dO_S$=change in the oxygen content is slag $O_S$=oxygen content in slag t=time $F_{CO_2}iP$=quantity of carbon dioxide, but when inert gas is used $F_{CO_2}iP=0$ 5. An oxygen-blown steelmaking furnace which continuously operationally corrects the course of a current hot metal blow based on a reference blow pattern representing the continuous change with time of a target oxygen content in slag, and also based on temperature of and carbon content in said hot metal as determined substantially immediately before completion of, and relative to a desired end point hot metal temperature and carbon content in, said current blow, comprising:

a steelmaking furnace;

first means for blowing pure oxygen into said furnace from thereabove and at least one of oxygen, carbon dioxide, and inert gas into said furnace from therebelow, second means for charging fluxes of preselected types and quantities into said furnace at any desired time during said current blow;

third means for measuring said temperature of and said carbon content in said hot metal at any desired time during said current blow;

fourth means for recovering exhaust gas in an unburnt state from said furnace;

fifth means for determining chemical composition of said exhaust gas;

sixth means for measuring quantity of said exhaust gas;

seventh means for adjusting lance level; said pure oxygen, carbon dioxide, and inert gas, said fluxes, said exhust gas and said lance level being used to implement charging and blowing out conditions for said current blow, eighth means for determining said charging and blowing out conditions, and for communicating operating instructions to said first, second, and seventh means in accordance with said reference blow pattern;

ninth means for statistically or theoretically computing, based on said charging and blowing out conditions and a past blow pattern, a continuous change with time of a target oxygen content in slag as said reference blow pattern, and for supplying said reference blow pattern to said eighth means;

tenth means for computing change, with time, of current blow hot metal oxygen content in slag based on current charging and blowing out conditions, and for supplying said current oxygen content in slag to said eighth means, said eighth means determining the difference in oxygen content in slag between said current blow and said reference blow pattern and communicating an amount of operational correction to said first, second, and seventh means in accordance therewith; and eleventh means for actuating said third means substantially immediately before completion of said current blow, for estimating said temperature and carbon content at said end point based on the temperature and carbon content measured by said third means, and on said difference determined by said eighth means, and communicating operational instructions to said eighth means based thereon.

* * * * *